United States Patent [19]

Lambert

[11] Patent Number: 4,884,819

[45] Date of Patent: Dec. 5, 1989

[54] MULTI-DIMENSIONAL GAMES AND PLAYING BOARDS

[76] Inventor: W. Clark Lambert, 66 Plymouth St., Montclair, N.J. 07042

[21] Appl. No.: 182,165

[22] Filed: Apr. 15, 1988

Related U.S. Application Data

[63] Continuation-in-part of Ser. No. 11,731, Feb. 6, 1987, abandoned.

[51] Int. Cl.[4] ..... A63F 3/02

[52] U.S. Cl. ..... 273/261; 273/271

[58] Field of Search ..... 273/241, 260, 261, 269, 273/271

[56] References Cited

U.S. PATENT DOCUMENTS 4,019,744 4/1977 Pizur ..... 273/269

4,131,282 12/1978 Boyer et al. ..... 273/271

OTHER PUBLICATIONS

"Four-Dimensional Tic-Tac-Toe" by Donald R. Burleson, copyright 1971, publ. by Educator Books, Inc., San Angelo, Texas.

*Primary Examiner*—Anton O. Oechsle

*Attorney, Agent, or Firm*—John N. Bain; Raymond J. Lillie

[57] ABSTRACT

A game board comprising a plurality of player spaces defining a playing field, a first playing field having no less than 3 player spaces each having a specific spatial relationship to each other arranged in at least one row of player spaces having no less than two player spaces each and at least one column of player spaces having no less than two player spaces each, at least one row of player spaces and one column of player spaces having a common player space, at least one column of spaced-apart playing fields, each playing field in each column other than the first said playing field having at least one player space, and at least one row of spaced-apart playing fields, each playing field in each row except the first said playing field having at least one player space each, at least one row of playing fields and one column of playing fields having a common playing field. Other embodiments also include the use of boards that are equivalent to the above-identified game board, as well as sequences of game boards formed by a progression of duplications of the above-identified game board.

25 Claims, 12 Drawing Sheets

WARP II TO WARP III

WARP II TO WARP IV

WARP IV TO WARP III

WARP III TO WARP IV

| | 1 | 2 | 3 | 4 | 5 | 6 | |
|---|---|---|---|---|---|---|---|
| A | D4 | A4 | D5 | A5 | D6 | A6 | A |
| B | E4 | B4 | E5 | B5 | E6 | B6 | B |
| C | F4 | C4 | F5 | C5 | F6 | C6 | C |
| D | D1 | A1 | D2 | A2 | D3 | A3 | D |
| E | E1 | B1 | E2 | B2 | E3 | B3 | E |
| F | F1 | C1 | F2 | C2 | F3 | C3 | F |
| | 1 | 2 | 3 | 4 | 5 | 6 | |

WARP III TO WARP I

FIG. 17

| | 1 | 2 | 3 | 4 | 5 | 6 | |
|---|---|---|---|---|---|---|---|
| A | B2 | A2 | B4 | A4 | B6 | A6 | A |
| B | D2 | C2 | D4 | C4 | D6 | C6 | B |
| C | F2 | E2 | F4 | E4 | F6 | E6 | C |
| D | B1 | A1 | B3 | A3 | B5 | A5 | D |
| E | D1 | C1 | D3 | C3 | D5 | C5 | E |
| F | F1 | E1 | F3 | E3 | F5 | E5 | F |
| | 1 | 2 | 3 | 4 | 5 | 6 | |

WARP III TO WARP II

FIG. 18

| | 1 | 2 | 3 | 4 | 5 | 6 | |
|---|---|---|---|---|---|---|---|
| A | D4 | D5 | D6 | A4 | A5 | A6 | A |
| B | D1 | D2 | D3 | A1 | A2 | A3 | B |
| C | E4 | E5 | E6 | B4 | B5 | B6 | C |
| D | E1 | E2 | E3 | B1 | B2 | B3 | D |
| E | F4 | F5 | F6 | C4 | C5 | C6 | E |
| F | F1 | F2 | F3 | C1 | C2 | C3 | F |
| | 1 | 2 | 3 | 4 | 5 | 6 | |

WARP IV TO WARP I

FIG. 19

| | 1 | 2 | 3 | 4 | 5 | 6 | |
|---|---|---|---|---|---|---|---|
| A | B2 | B4 | B6 | A2 | A4 | A6 | A |
| B | B1 | B3 | B5 | A1 | A3 | A5 | B |
| C | D2 | D4 | D6 | C2 | C4 | C6 | C |
| D | D1 | D3 | D5 | C1 | C3 | C5 | D |
| E | F2 | F4 | F6 | E2 | E4 | E6 | E |
| F | F1 | F3 | F5 | E1 | E3 | E5 | F |
| | 1 | 2 | 3 | 4 | 5 | 6 | |

WARP IV TO WARP II

FIG. 20

MULTI-DIMENSIONAL GAMES AND PLAYING BOARDS

This application is a continuation-in-part of application Ser. No. 011,731, filed February 6, 1987, now abandoned.

This application relates to a group of games and game boards wherein the games may be played in more than three dimensions. More particularly, this application relates to a game or games which can be played in four dimensions and a board for playing games in four or more dimensions.

Games and game boards of the prior art have been played in two, and even sometimes three, dimensions. Examples of such games are chess, checkers, tic-tac-toe, Chinese checkers, Scrabble, Othello, Go, and backgammon. The game board of the present invention enables one to play these popular board games as well as other games, in four or more dimensions.

The game board of the present invention comprises a plurality of spaces defining a playing area, a first playing field having no less than three player spaces, each space having a specific spatial relatinhship to each of the other spaces. All of the spaces are arranged in at least one row of player spaces having no less than two player spaces each and at least one column of player spaces having no less than two player spaces each, at least one row of player spaces and one column of player spaces having a common player space, at least one column of spaced-apart playing fields, each playing field in each column other than the first said playing field having at least one player space, and at least one row of spaced-apart playing fields, each playing field in each row except the first said playing field having at least one player space each, at least one row of playing fields and one column of playing fields having a common playing field. In one embodiment, the number of rows of player spaces in each field, the number of columns of player spaces in each playing field, the number of rows of spaced-apart playing fields, and the number of columns of spaced-apart playing fields are not all the same number.

In yet another embodiment, there is provided a primary playing board and equivalent playing boards, which may be known as inter-dimensional warps. Each board has an equal number of playing spaces. Each space has a positionally defined relationship to each of the other player spaces. The primary board has player spaces whereby each player space is defined by a permutation of at least four positional parameters. Each player space on the primary board has one and only one equivalent space in each equivalent board. Each player space on the primary board has an equivalent player space on each equivalent board, each equivalent player space on each equivalent board being defined by the same positional parameters as define each player space on the primary board. The permutation of positional parameters of each player space on each of the equivalent boards varies such that at least two positional parameters of each equivalent player space on each equivalent board have been interchanged with the positional parameters of its equivalent player space on each of the other equivalent player boards and the primary board, and no two equivalent boards have the same permutation of positional parameters for each player space.

The invention will now be described with respect to the drawings, wherein:

FIGS. 9–20 are charts which depict the location of particular playing spaces on one board as depicted in any one of FIGS. 5–8, and their location on another equivalent board as depicted in any one of FIGS. 5–8;

Figure 1:
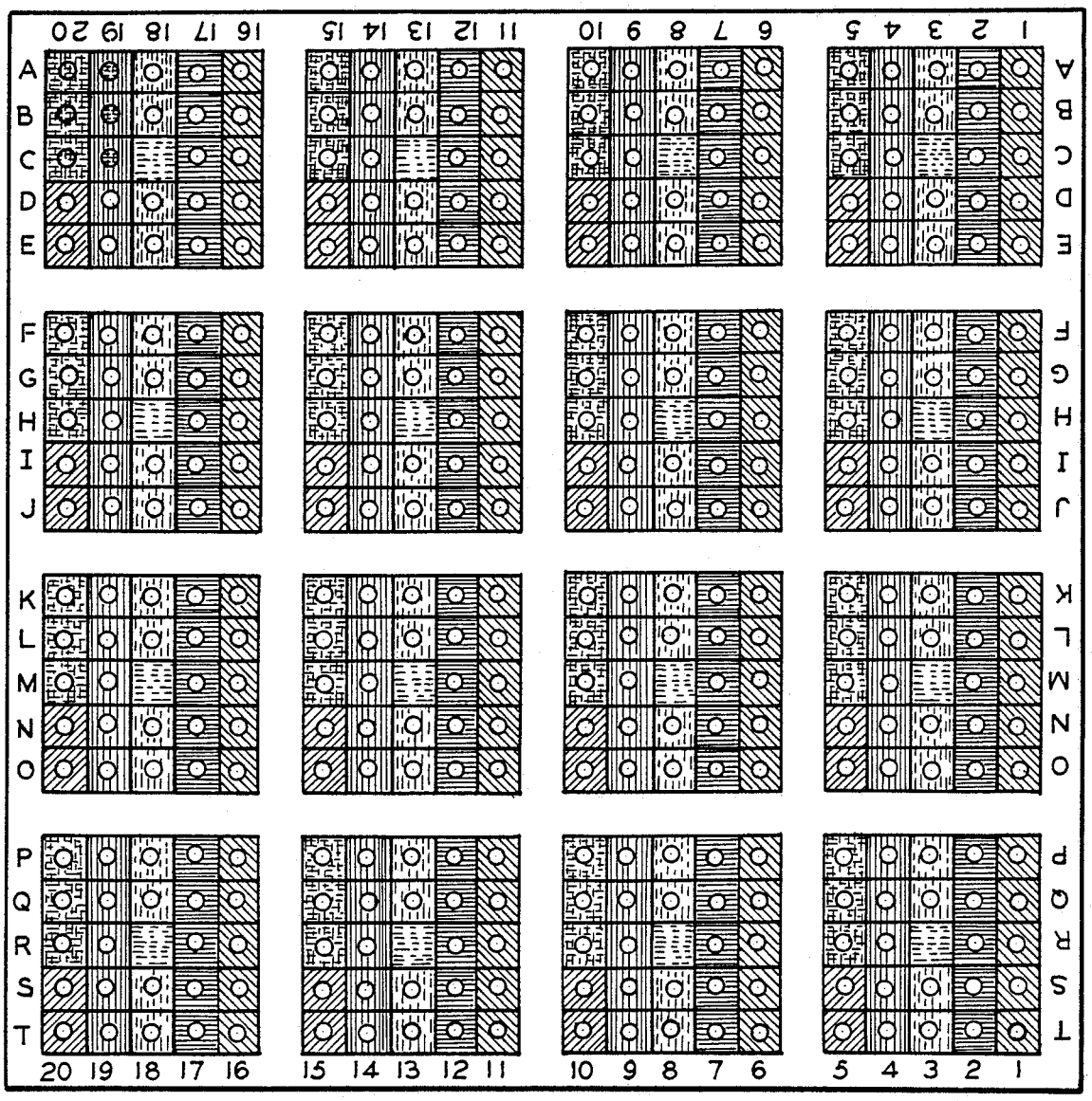
FIG. 1 is a view of an embodiment of a game board in accordance with an embodiment of the present invention.

In a preferred embodiment, although the scope of the invention is not to be limited to this embodiment, each player space is of two colors, each color defining two positional parameters. The shade (dark versus light) of the color defines one positional parameter, and the hue defines another positional parameter. A central color is definitive of the field in which the space is located and a peripheral color is definitive of the position of the playing space in the field. When the game is played using a primary board and equivalent playing boards, the central color will be definitive of the field and the peripheral color definitive of the position of the playing space in the field on only one of the boards, or inter-dimensional warps. In this embodiment, the playing space in one field corresponds to playing spaces in other fields of the same peripheral color. Each playing space has a certain relationship to other playing spaces in a particular field and may have the same relationship to the corresponding playing spaces in another field, except that the relationship is in a different overall position in another dimension or dimensions. It therefore can be seen that the purpose of the plurality of fields is for one to envision better the various dimensions and the relationship between dimensions. For example, one can envision a row or column of fields stacked one on top of the other, thereby creating vertical rows extending upwardly from the plane of the playing surface. One also can visualize diagonal rows extending upwardly from the plane of the playing surface. As applied to a game of tic-tac-toe, for example, one can score tic-tac-toe by placing men on the required number of squares whereby the men are all on squares having the same peripheral color, but each square is on a different field in the same row of fields or the same column of fields. In addition to crossing from one field to another in the same row or in the same column of fields, one can go from one row to another and/or from one column to another while traveling from one field to another. One can start a row of tic-tac-toe from a field in a specific row and/or column, and go to the next corresponding positional square, but in a field in a different row and/or column, and continue this progression until one scores tic-tac-toe or a similar type of point in variations of tic-tac-toe. The color scheme of the game board can be varied somewhat so as to accommodate the inclusion of special player spaces, depending upon the rules of the game. For example, a player space may be of one color so as to be a "wild" space which, although not actually occupied by either player, may be counted as an occupied space by either player.

The explanation just given above as to how a tic-tac-toe game can be played in at least four dimensions can also apply to other games such as chess, checkers, backgammon, Chinese checkers, Scrabble, Go, Othello, and other popular board games and variations of games. All games are played on a primary playing board. In another embodiment of this invention, there is provided a combination of a primary playing board and equivalent playing boards, each playing board consisting of an equal number of playing spaces each having a positionally defined relationship to each of the other player spaces. The primary board has player spaces whereby each player space is defined by a permutation of at least four positional parameters. Each player space on the primary board has one and only one equivalent space in each equivalent board. Each player space on the primary board has an equivalent player space on each equivalent board, each equivalent player space on each equivalent board being defined by the same positional parameters as define each player space on the primary board, the permutation of positional parameters of each player space on each of the equivalent boards varies such that at least two positional parameters of each equivalent player space on each equivalent board have been interchanged with the positional parameters of its equivalent player space on each of the other equivalent player boards and the primary board, and no two equivalent boards have the same permutation of positional parameters for each player space.

The primary board, as well as the equivalent board or boards, may have coordinates which correspond to rows and columns of player spaces. The coordinates serve as an aid in locating a particular player space, having certain indicia of its positional parameters, on an equivalent board.

The purpose of the equivalent board is to give one a better understanding of the different dimensions in which a game is played. All of the positional relationships among player spaces and player pieces may not be readily understandable from looking at just one player board. The rearrangement of the squares on each equivalent board enables one to see different positional relationships that were not initially apparent. This enables one to have a better understanding of the multi-dimensional games being played and enables one to undertake better preparation and planning of strategies.

Another embodiment of this invention relates to a sequence of game boards. This sequence comprises a first game board as described above and at least one duplicate game board. The duplicate game board or boards are duplicated in the direction of at least one of the directions of the columns and rows of the first game board, thus providing one or more additional game boards in the sequence. This row or column of game boards then can also be duplicated in its entirety in at least one additional direction selected from the directions of the columns and rows. Thus, a sequence is developed whereby one progressively duplicates game boards whereby each game board is the original board plus one or more duplicates of the immediately preceding game board.

This embodiment is useful in playing games of more than four dimensions. For example, one duplicates the game board of the present invention in the direction of at least one of the directions of the columns and rows to make a game board whereby one can play a game in five dimensions. The five-dimensional game board is therefore the original game board plus its duplicate or duplicates. This five-dimensional board can then be duplicated one or more times to make a board for a six-dimensional game, the six-dimensional board can be duplicated one or more times to make a board for a seven-dimensional game, and so on. A progression of duplications can therefore be made. This progression may be unlimited, going to any finite number desired. The termination of the progression therefore is determined by the number of dimensions in which one desires to play a game.

The following are examples of a variation of a tic-tac-toe type of game which can be played in four dimensions and is played on a game board in accordance with this invention, and to illustrate the interrelationships between a primary board and corresponding equivalent boards. The scope of the invention, however, is not intended to be limited by these specific examples.

EXAMPLE 1

This Example is played in hyperspace, i.e., in four dimensional space. The position of the opposing players' men in hyperspace is indicated by positions the players select on a game board in which the four dimensions have been warped onto a two-dimensional surface. A board may therefore be defined as a Warp. The number of warps employed may be from 1 to 24 in the case of a four-dimensional game. Each warp depicts a different rearrangement of the dimensional relationship of the player spaces from another warp.

Points are scored in this Example by creating Quarks. A Quark consists of four of your men in a row in any of the game's four dimensions or in any combination of those dimensions.

A Warp consists of a group of smaller playing boards, as shown in FIG. 1.

Figure 2:
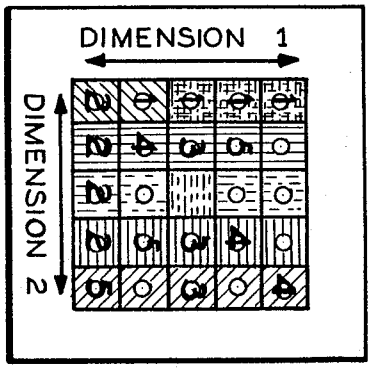
FIG. 2 is a view of a playing field within the board of FIG. 1.

Each of these smaller playing boards is known as a FIELD. Each field is a two-dimensional playing board all by itself. A field is shown in FIG. 2. In this example, sixteen fields are depicted on the warp. Quarks may therefore be scored within a single field simply by arranging four of your men in a row. Five examples of this are provided. In Example Quark 1, in which the positioning of the four men are indicated by numbers "1" (i.e., each of the four men have been numbered "1"), your four men have been arranged in a row in a single dimension, the forward and back dimension, which is designated as Dimension 1. Example Quarks 2 and 3 are entirely in the side-to-side (lateral) dimension, designated as Dimension 2. Note that, in Example 3, there are only three men. The center space, which may be depicted as a silver space, is designated as WILD and may be used by either player to score Quarks. No men are placed on Wild (silver) spaces by either player. This applies to any Warp or board employed. Note that the silver spaces will be in different places on different warps.

Example Quarks 4 and 5 are in both Dimension 1 and Dimension 2. Although both use the Wild space in the examples shown, Quarks in Dimensions 1 and 2 need not use a Wild space (i.e., Quarks may be created by placing four men in a row in four spaces, none of which is Wild). Note that a Wild space may be used more than once, to score different Quarks, by either player.

Figure 3:
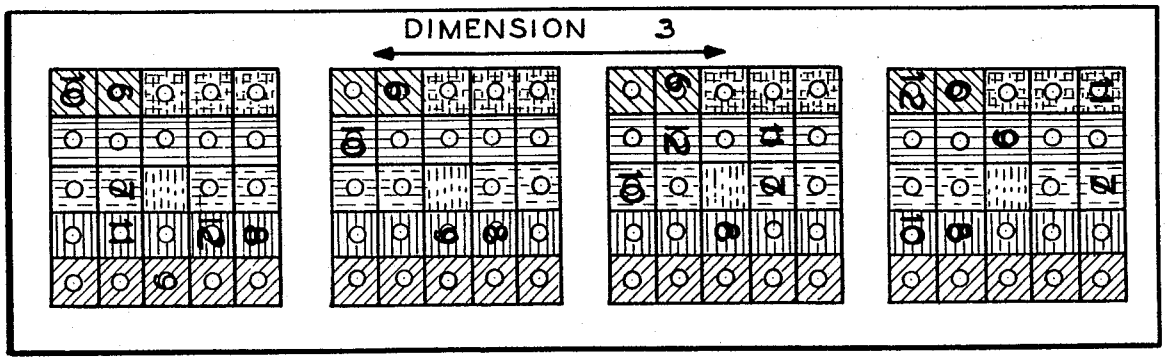
FIG. 3 is a view of a column of playing fields within the board of FIG. 1.
Figure 4:
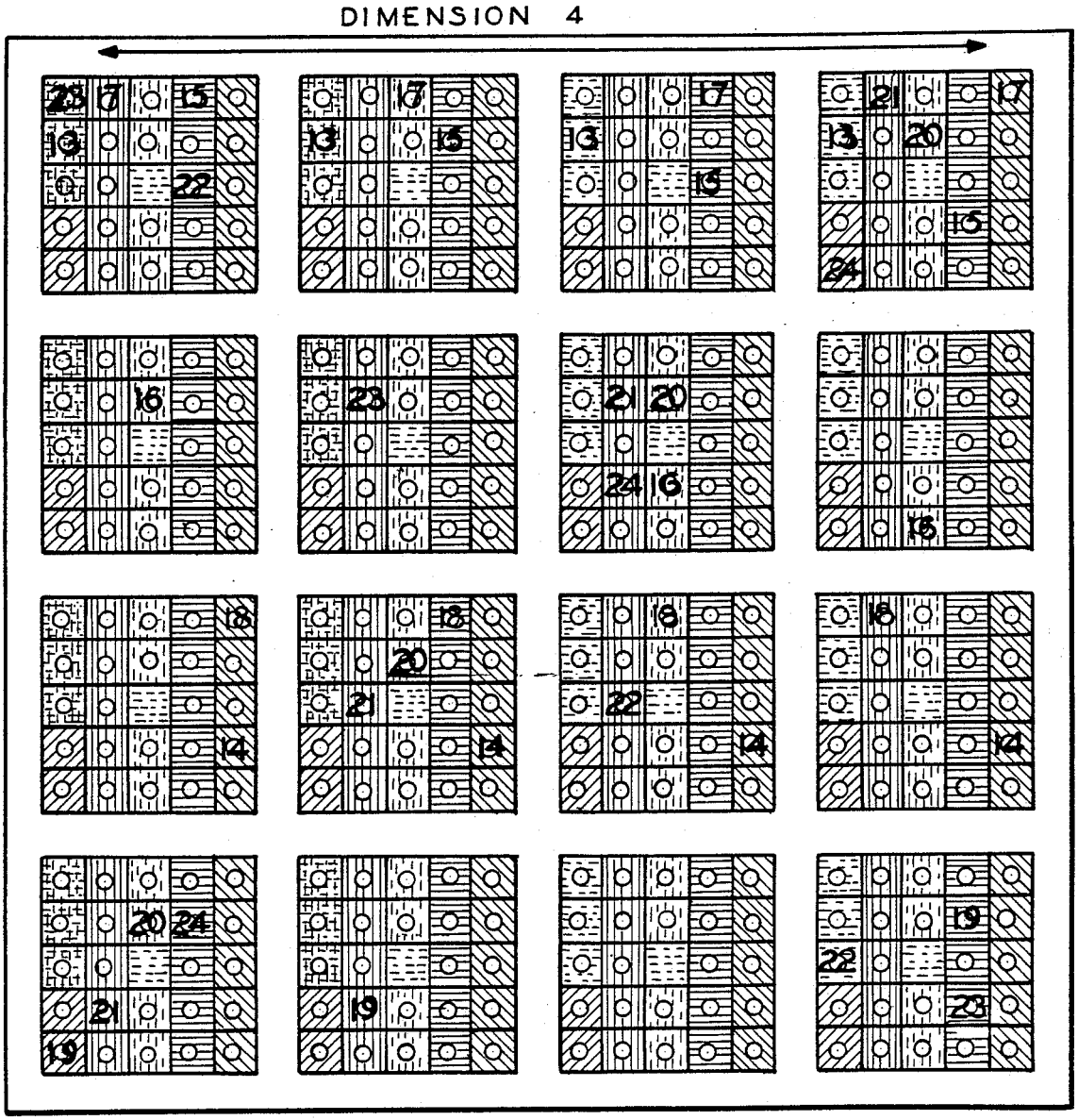
FIG. 4 is a view of the board of FIG. 1 showing illustrative examples of scoring combinations on said board.

As shown in FIGS. 1 and 4, the sixteen fields in the warp may be looked upon as four columns of four fields each. One such column is depicted in FIG. 3.

Imagine that this column of fields (FIG. 3) is in fact a three-dimensional structure, with fields stacked on top of one another. There is then a new, vertical dimension, between fields. In this vertical dimension, each square on each field is directly adjacent to (i.e., above or below) the corresponding square on the field just below or above it. Example Quark 6 is a Quark in this new vertical dimension, which is defined as Dimension 3. Example Quark 6 might be thought of as resembling an elevator shaft in a building, with the fields representing different planes of floors. In addition to being looked upon as a vertical dimension, however, Dimension 3 may also be considered as a second forward and back dimension, between fields. (Dimensions 1 and 2 are within fields). You may also make Quarks in Dimensions 1 and 3 (Example Quarks 7 and 8), in Dimensions 2 and 3 (Example Quarks 9 and 10), and in Dimensions 1, 2, and 3. (Example Quarks 11 and 12). In standard three dimensional thinking, Example Quarks 7 and 8 may be thought to resemble staircase extending forward and back, Example Quarks 9 and 10 to resemble staircases oriented side to side, and example Quarks 11 and 12 to resemble staircases oriented in caticornered directions. It is helpful to go through these examples both considering this column of fields as a three-dimensional structure with the fields stacked one above the other and as a three-dimensional figure with two forward and back dimensions and one lateral dimension.

In the final dimension, designated as Dimension 4, a series of columns is added one beside the other just as fields were added one on top of the other in the above example. Dimension 4 is therefore a second side-to-side (lateral) dimension, between fields, just as Dimension 2 is a side-to-side dimension within fields. This is illustrated in FIG. 4.

Example Quarks 13 and 14 are in this new, fourth dimension (FIG. 4). Example Quarks 15 and 16 are in Dimensions 1 and 4, Example Quarks 17 and 18 are in Dimensions 2 and 4, Example Quark 19 is in Dimensions 1, 2 and 4, Example Quark 20 is in Dimensions 3 and 4, Example Quark 21 is in Dimensions 1, 3 and 4, Example Quark 22 is in Dimensions 2, 3 and 4, and Example Quarks 23 and 24 are in Dimensions 1, 2, 3 and 4.

Although only one warp is illustrated for this example, the game may be played on more than one board, or warp, simultaneously. Charts can be included which illustrate the relationships between the player spaces on the different warps. When more than one warp is used, the opposing players can chart moves made on one warp by placing men on corresponding places on another warp. The warps, which illustrate different arrangements of the dimensional relationships, therefore serve as an aid in illustrating various aspects of the development of the strategies of the game as it is played. The game may also be played by various numbers of players and various numbers of men may be used in playing the game. Once a man is placed on a warp or board, it is not removed. The game ends after all players have moved in turn and placed all their men on the boards or warps. The player, or team of players, scoring the most Quarks wins.

EXAMPLE 2

Figure 5:
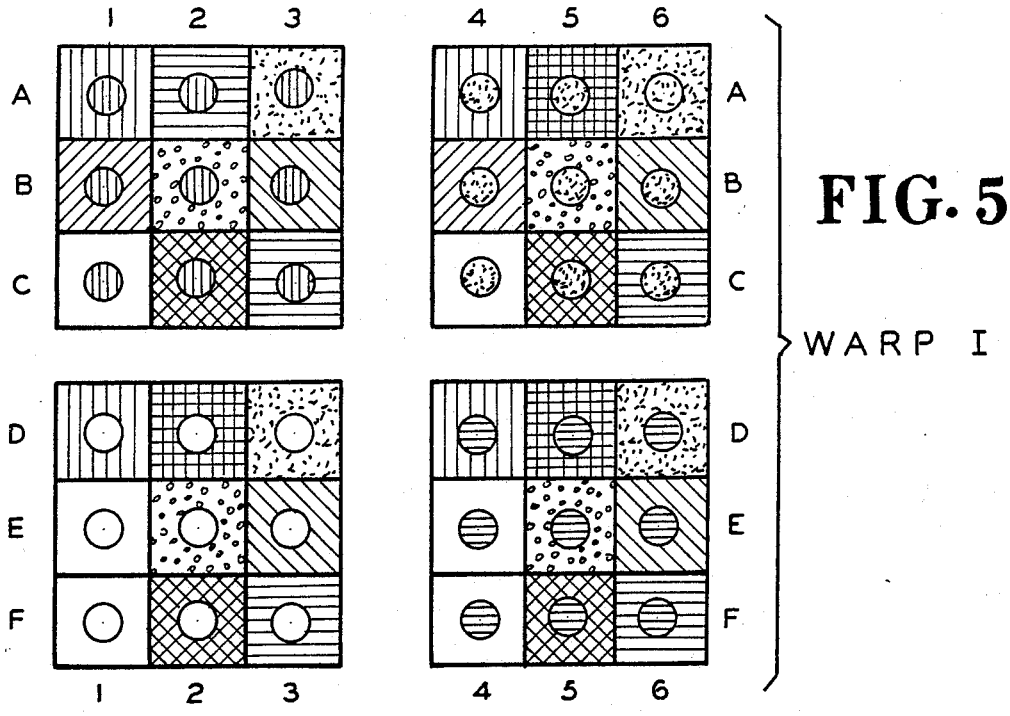
FIG. 5 is a view of another embodiment of a game board in accordance with the present invention, said board being illustrative of a first inter-dimensional warp.
Figure 6:
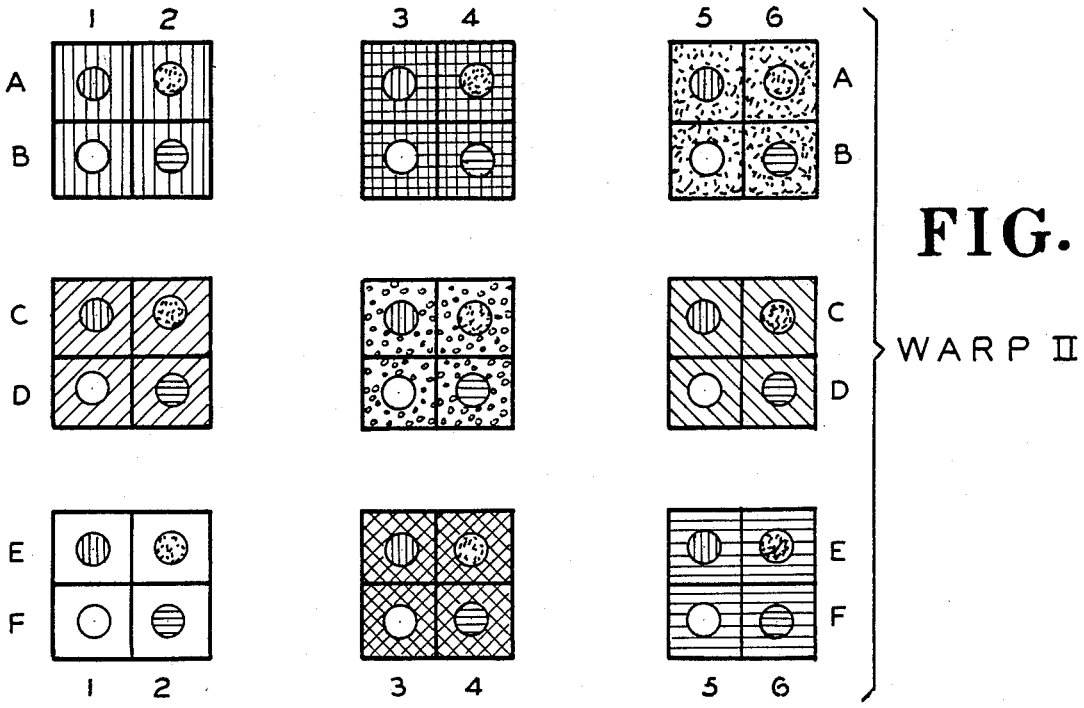
FIG. 6 is a view of the playing spaces of the game board of FIG. 5 rearranged to depict a second inter-dimensional warp.
Figure 7:
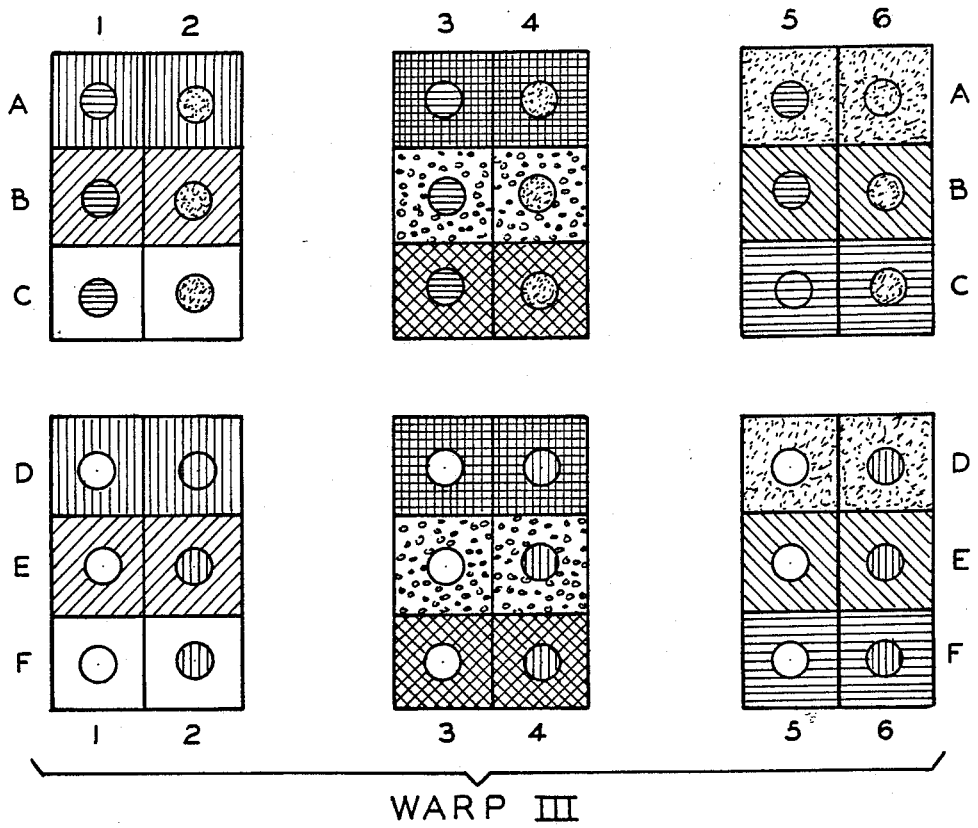
FIG. 7 is a view of the playing spaces of the game boards of FIGS. 5 or 6 rearranged to depict a third inter-dimensional warp.
Figure 8:
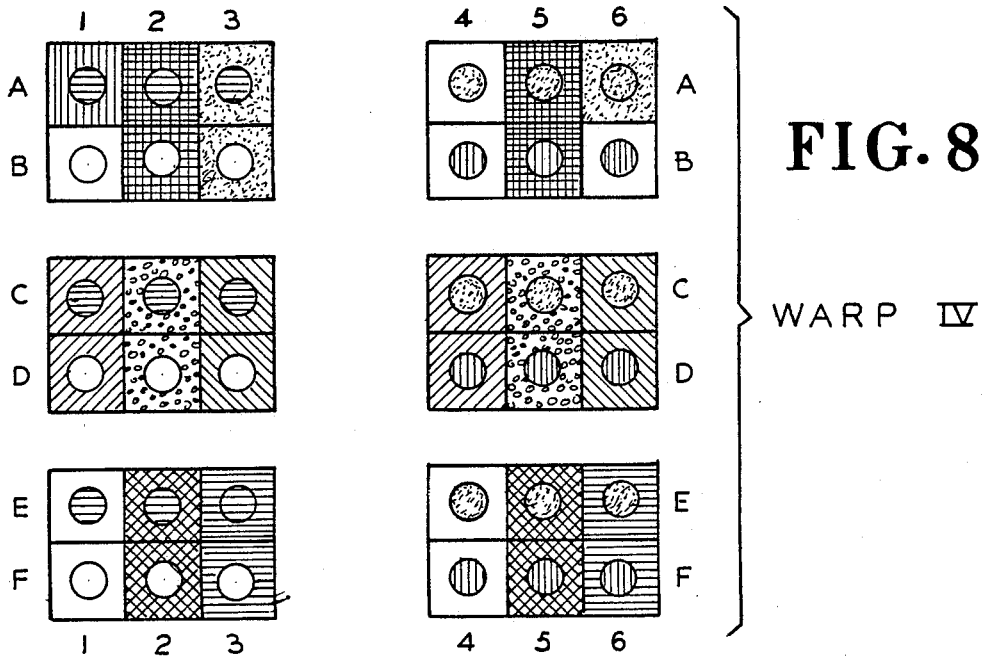
FIG. 8 is a view of the playing spaces of the game boards of FIGS. 5, 6, or 7 rearranged to depict a fourth inter-dimensional warp.

The purpose of this example is to show a plurality of boards, or warps, and to show the interrelationship between the player spaces on each of these warps. For demonstration purposes only, Warps I to IV are depicted in FIGS. 5 to 8. Each board, or warp, has 36 player spaces, each player space having two indicia of the positional parameters located on the player space. Each player space is also indicated by a row number (A to F), and a column, number (1 to 6). In Warp I, as shown in FIG. 5, the player spaces are segregated into 4 fields, arranged as two rows and two columns of fields. Each field has 9 player spaces and is arranged as three rows and three columns of player spaces. In Warp II, as shown in FIG. 6, the player spaces are arranged as 9 fields, with three rows and three columns of fields. Each field has 4 player spaces, with each field having 2 rows and two columns of player spaces. In Warp III, as shown in FIG. 7, the player spaces are in 6 fields, with the fields arranged as two rows and three columns of fields. Each field has 6 player spaces, with the player spaces arranged as three rows and two columns of player spaces. In Warp IV, as shown in FIG. 8, the player spaces are located in 6 fields. The fields are arranged in three rows and two columns. Each field has 6 player spaces which are arranged in two rows and three columns of player spaces.

Figure 9:
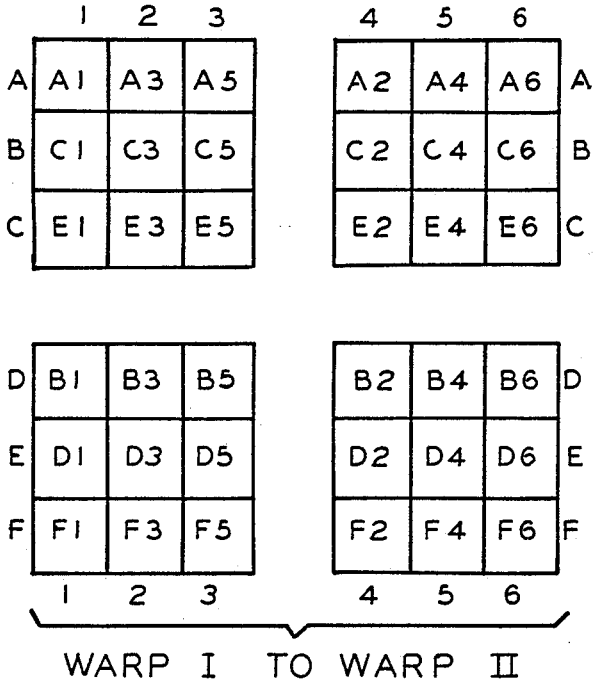
Figure 10:
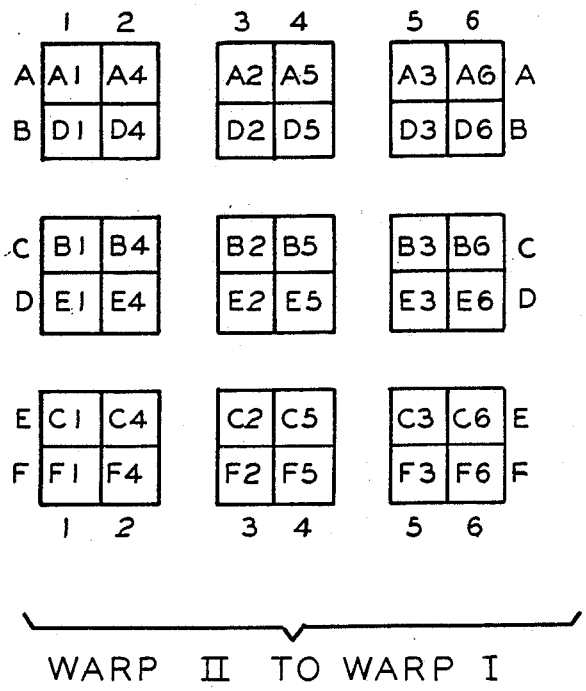
Figure 11:
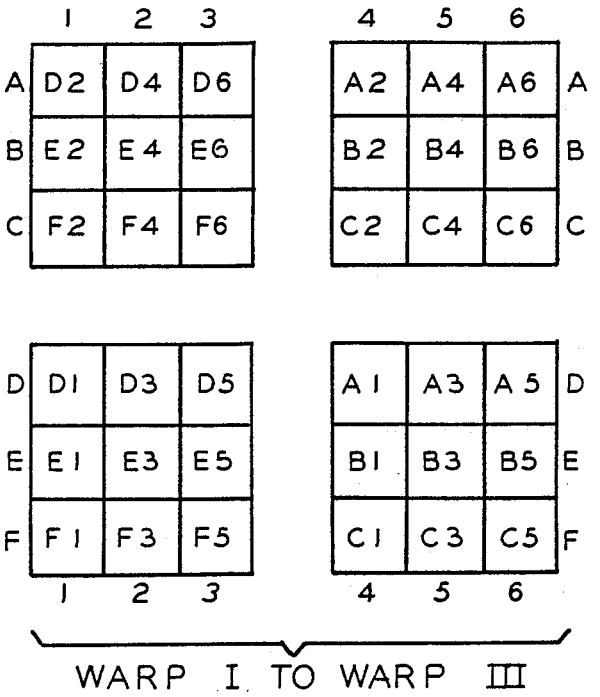
Figure 12:
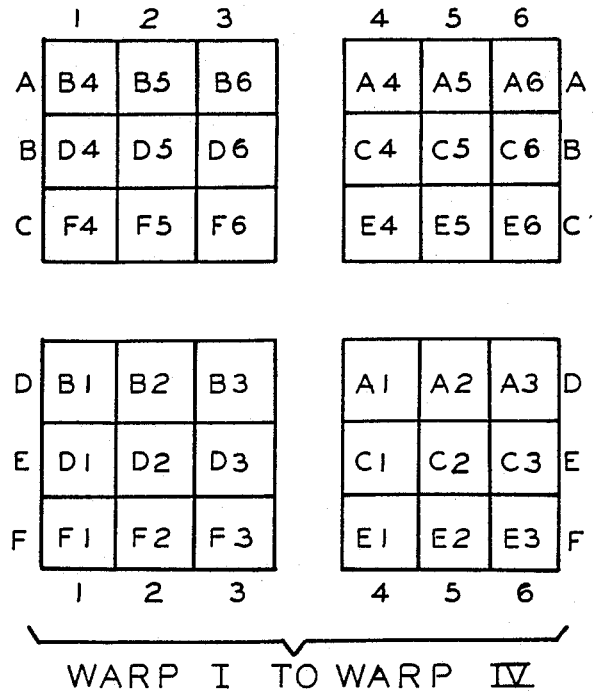
Figure 13:
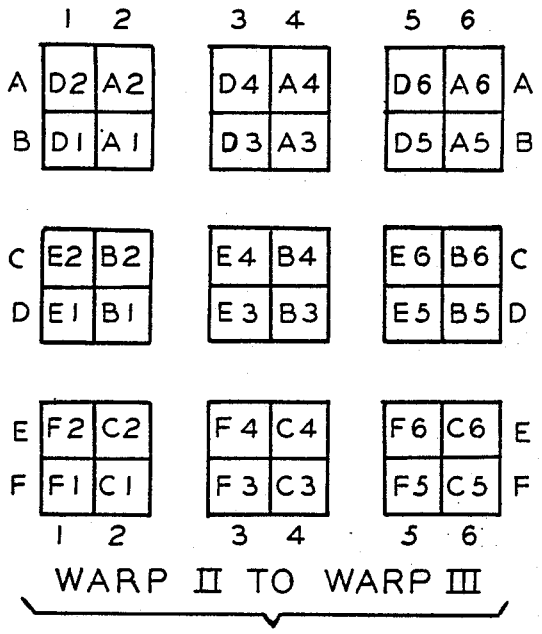
Figure 14:
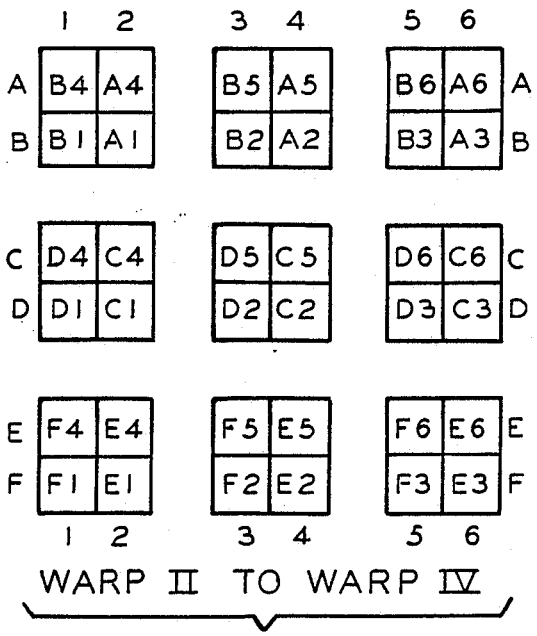
Figure 16:
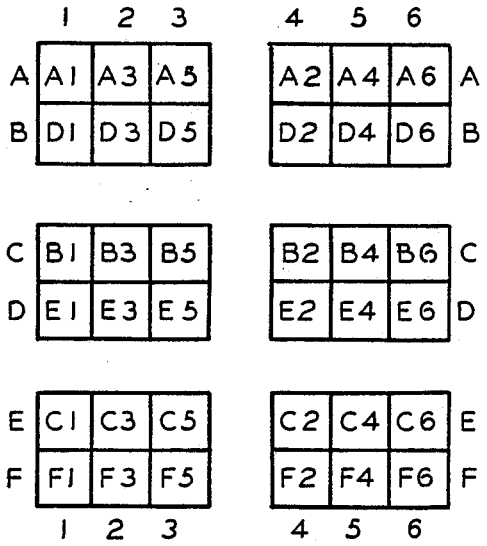
Figure 15:
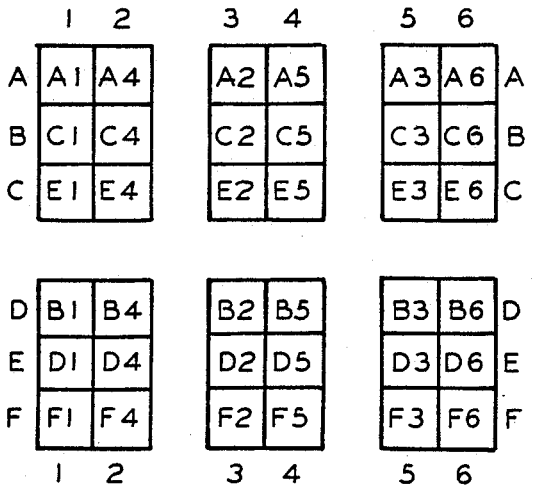

The navigational charts, shown in FIGS. 9 to 20, illustrate the rearrangements of the dimensions for each of the various warps, and the interrelationship of the player spaces to each other on each of the boards, or warps. The charts take the letter and number coordinates of each player space on one warp and give the letter and number coordinate of each of these player spaces on another warp. For example, if one wished to locate the corresponding squares to squares A1, B1, and C1 of Warp I on Warp II, one would refer to the navigational chart Warp I to Warp II as shown in FIG. 9, and find that the squares located at A1, B1, and C1 for Warp I are located at A1, C1, and E1 on Warp II, respectively. It can also be seen that these squares, which were a column of three squares in one field on Warp I are now the upper left corner squares in each of the fields in the left-hand column of fields on Warp II. This example therefore shows the possibilities of showing different spatial relationships of the player spaces to each other on different boards by rearranging the squares in order to depict a rearrangement of dimensions. Therefore, when more than one board is used, one can obtain more than one perspective of the development of playing strategies.

Although this Example depicts game boards having 36 player spaces, it is intended that the number of player spaces not be limited to this amount. For example, each warp or board may have a total of 400 player spaces, such as the board described in Example 1 and shown in FIGS. 1 and 4. Wild player spaces may also be depicted. Other spaces may be depcited as well, such as non-played spaces on a checkerboard. The board depicted in FIGS. 1 to 4 may be used in conjunction with equivalent boards or additional warps, and navigational charts may be drawn accordingly. In addition, the number of warps may be varied and can include any number up to the maximum number of warps permitted. The number of warps permitted depends on the number of dimensions intended to be depicted on the game board. The maximum number of warps can be expressed as n, wherein n equals the number of dimensions. For example, when a four dimensional game is played, up to $1\times2\times3\times4$, or 24 warps may be used.

EXAMPLE 3

This example depicts variations of the game of checkers as played in four dimensions on a two-dimensional board. In the standard two-dimensional game of checkers, a "non-kinged" checker moves one space in the forward dimension and then one space in the lateral dimension, or one space diagonally forward.

In playing the game of checkers in four dimensions, one is not limited by the movement of checkers as described above. Movements of non-kinged checkers are illustrated in FIGS. 21 to 24. The game boards depicted in these figures each depict 9 playing fields arranged as 3 rows and 3 columns of playing fields. Each field has 9 player spaces arranged as 3 rows and 3 columns of player spaces. The boards, however, are not limited to this specific embodiment.

Figure 21:
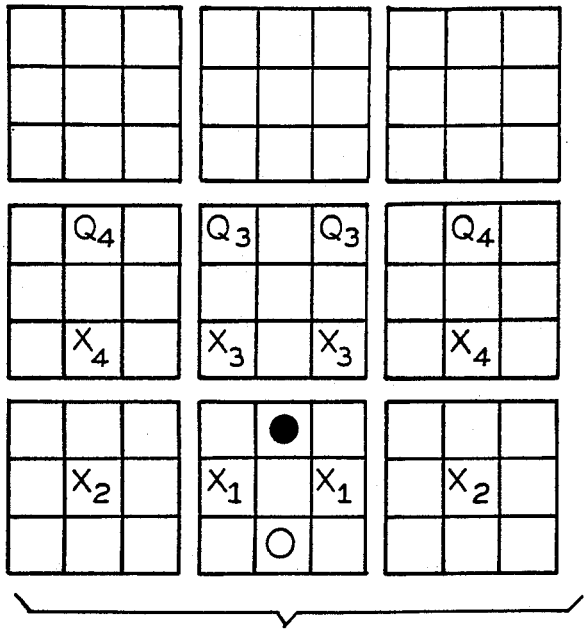
FIGS. 21–24 are views of a game board which indicates possible moves of checkers in a four-dimensional checkers game in accordance with the present invention.

In FIG. 21, there are shown two checkers depicted by a white circle and a black circle, respectively.

The spaces to which the white checkers may move are indicated by $X_1$, $X_2$, $X_3$ and $X_4$, and the spaces to which the black checkers may move are indicated by $Q_1$, $Q_2$, $Q_3$, and $Q_4$. Footnote 1 refers to a move of one forward space within a field and one lateral space within a field. Footnote 2 refers to a move of one forward space within a field, and one lateral space between fields. Footnote 3 refers to a move of one forward space between fields and one lateral space within fields. Footnote 4 refers to a move of one forward space between fields and one lateral space between fields.

Figure 22:
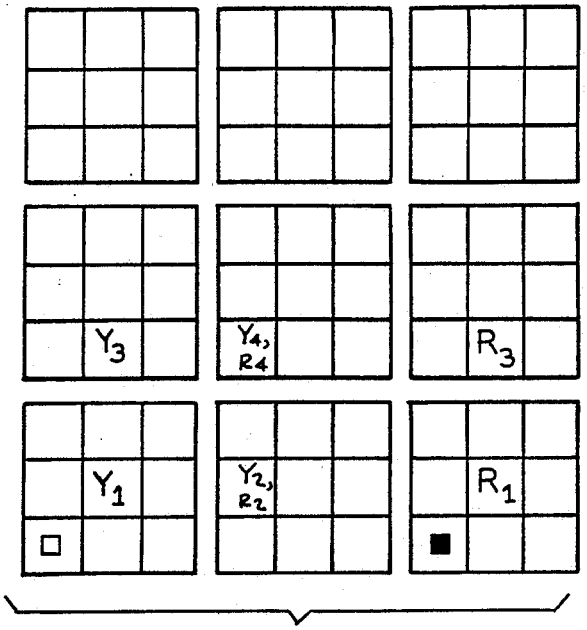

FIG. 22 depicts checkers indicated by white and black squares and the squares to which they can move as indicated by $Y_1$ to $Y_4$ and $R_1$ to $R_4$, respectively. The footnotes 1 to 4 indicate the same types of moves as described for FIG. 21.

Figure 23:
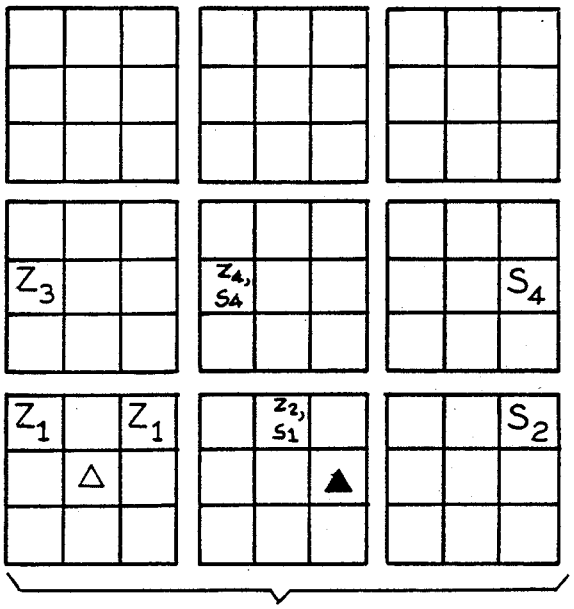
Figure 24:
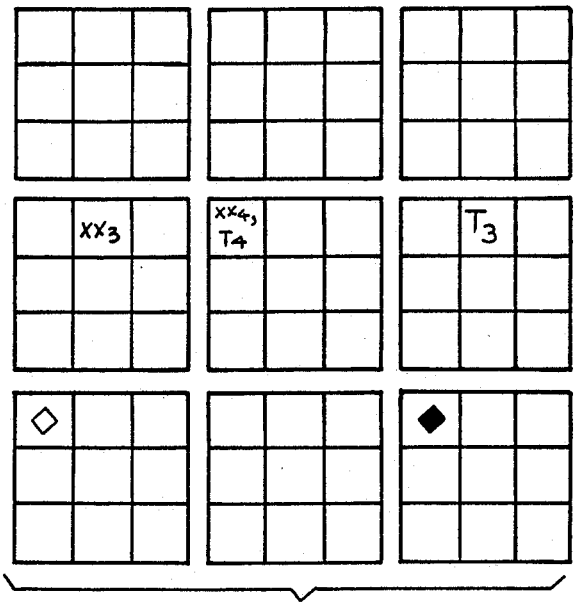

FIGS. 23 and 24 also depict possible movements of non-kinged checkers located at positions other than these shown in FIGS. 21 and 22. Each checker is indicated by a white or black symbol and the moves are shown by letter and footnote codes as described above.

FIGS. 25 to 28 depict how non-kinged checkers can jump other checkers in the four-dimensional context.

The boards depicted in FIGS. 25 to 28 each have 12 fields arranged in 3 rows and 4 columns of fields. Each field has 9 player spaces arranged as 3 rows and 3 columns of player spaces.

Figure 25:
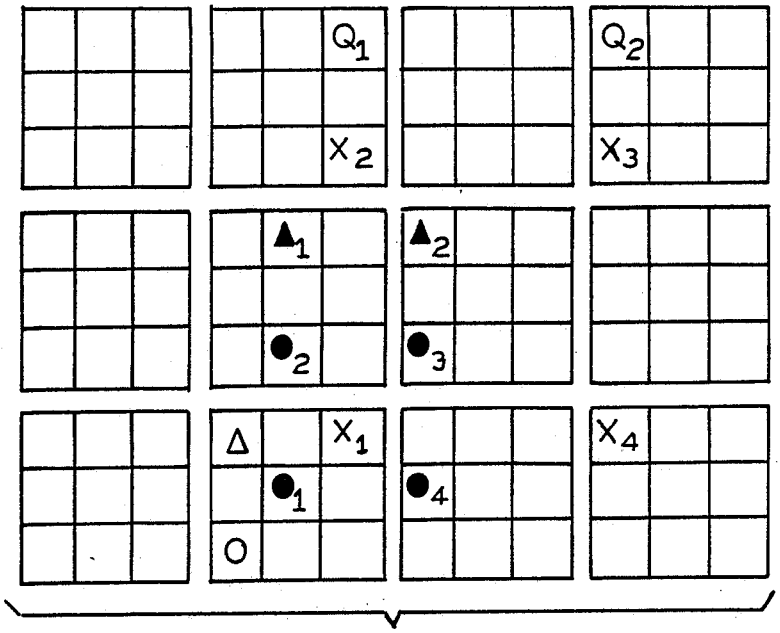
FIGS. 25–28 are views of a game board which indicates possible jump moves of checkers in a four-dimensional checker game in accordance with the present invention.

FIG. 25, for example depicts two checkers indicated by a white circle and a white triangle. The black circles and triangles, which also have number footnotes, denote checkers which can be jumped by the white checkers.

The jump moves which can be made by the checker symbolized by the white circle are indicated as $X_1$ to $X_4$, and the jump moves which can be made by the white triangle checker are indicated as $Q_1$ and $Q_2$. As shown in FIG. 25, the checker symbolized by the white circle on a conventional checkerboard normally would move to the space occupied by black circle checker number 1. In this case, however, the "white circle" checker can jump "black circle" checker number 1 and occupy space $X_1$. In the four-dimensional game, however, the "white circle" checker could normally also move to the spaces occupied by "black circle" checkers 2, 3, and 4. In these cases, however, the white circle checker can jump these checkers. "Black circle" checker number 2 is located at a space which is positioned one forward space between fields, and one lateral space within fields from the white circle checker. In jumping black circle checker 2, the white circle checker would move to the space occupied by black circle checker 2 and then move one space forward between fields and one space laterally within a field to land at the place denoted by $X_2$. Black circle checker 2 would then be removed from the board. Black circle checker 3 and $X_3$ illustrate how a jump is made over a piece located one space forward between fields and one space lateral between fields away from the white circle checker. Black circle checker 4 and $X_4$ illustrate how a jump is made over a piece located one space forward within a field and 1 space lateral between fields away from the white circle checker. Black triangle checkers 1 and 2, as well as $Q_1$ and $Q_2$, indicate jumps which can be made by the white triangle checker. Black triangle 1 and $Q_1$ indicate a jump which is made over a piece located one space forward between fields and one space lateral within a field from the white triangle checker, and black triangle checker 2 and $Q_2$ indicate a jump which is made over a piece located one space forward between fields and one space lateral between fields from the white triangle checker.

Figure 26:
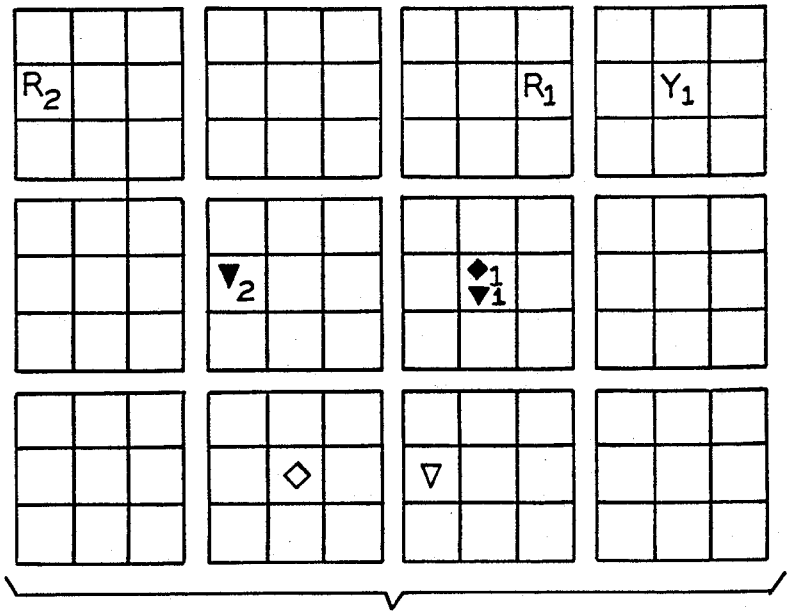
Figure 27:
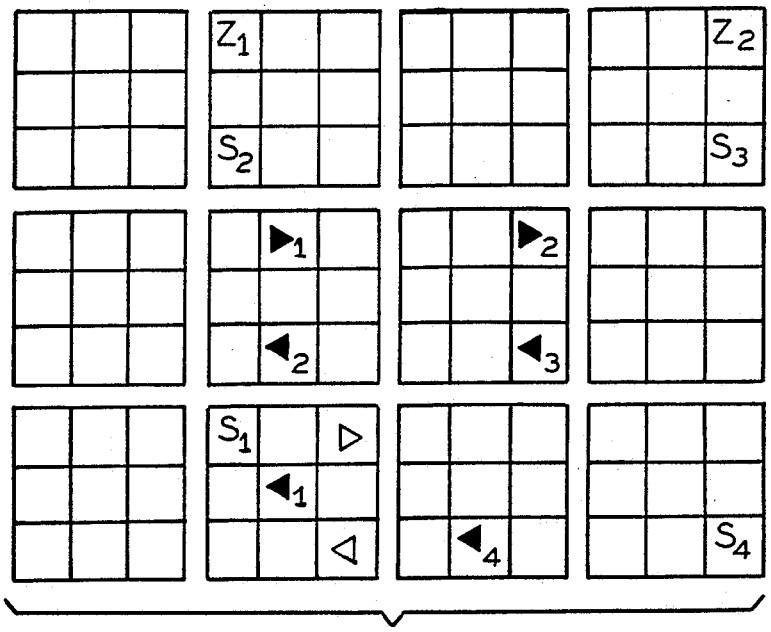
Figure 28:
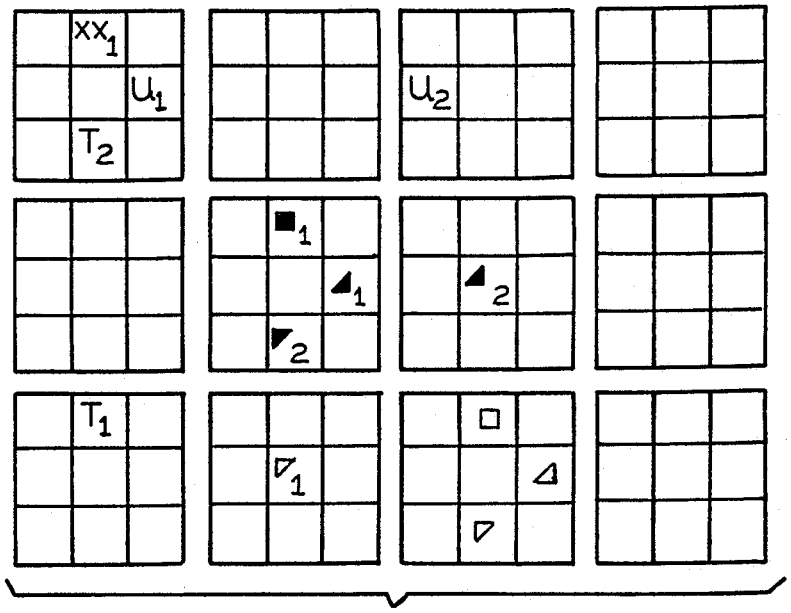

FIGS. 26 to 28 depict positions of other playing pieces, denoted by white symbols of various geometric shapes, pieces to be jumped, denoted by corresponding numbered black pieces having geometric shapes corresponding to the white pieces, and letters having numbered subscripts denoting to where the white checkers may move. Each letter corresponds to a white checker symbolized by a geometric shape. The geometric shapes are for illustrative purposes only and are not intended to be definitive of the shape of the actual playing pieces.

FIGS. 29 to 32 depict the movements of "kinged" checkers in an embodiment of a four-dimensional game of checkers on a two-dimensional board. The boards shown in FIGS. 29 to 32 have 9 playing fields arranged as 3 rows and 3 columns of fields. Each playing field has 9 player spaces arranged as 3 rows and 3 columns of player spaces. As stated above, this type of board is only intended as an example of a type of board which may be used.

In the standard two-dimensional game of checkers, "kinged" checkers may move one space forward or backward within the playing field, and then one space laterally within the field. In the four-dimensional game herein described, a checker may move one space forward or backward, within a field or between fields, and then one space laterally within a field or between fields.

Figure 29:
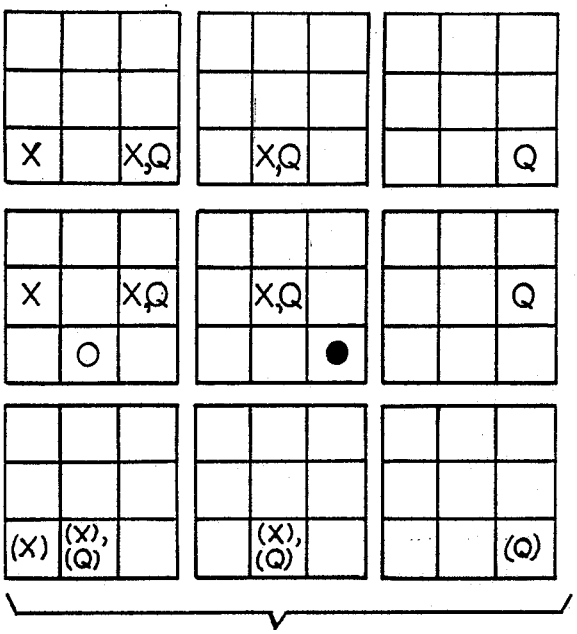
FIGS. 29–32 are views of a game board which indicates possible moves by kinged checkers in a four-dimensional checkers game in accordance with the present invention.
Figure 30:
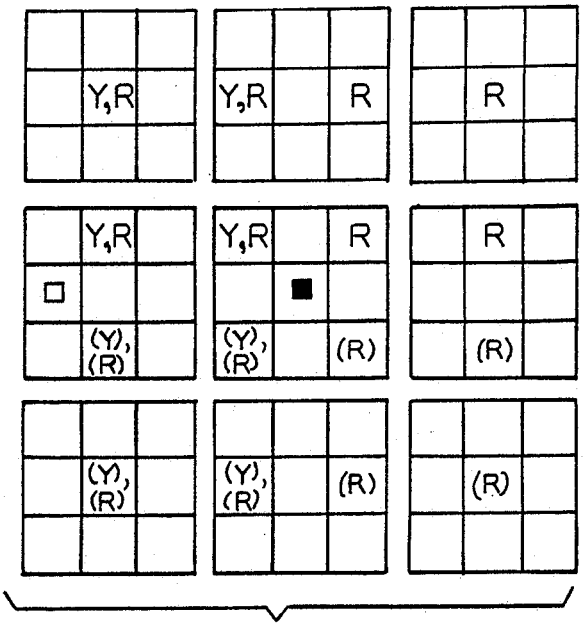
Figure 31:
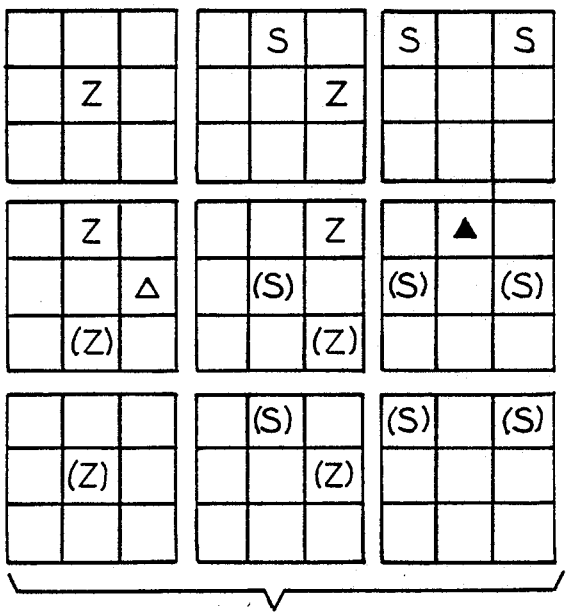
Figure 32:
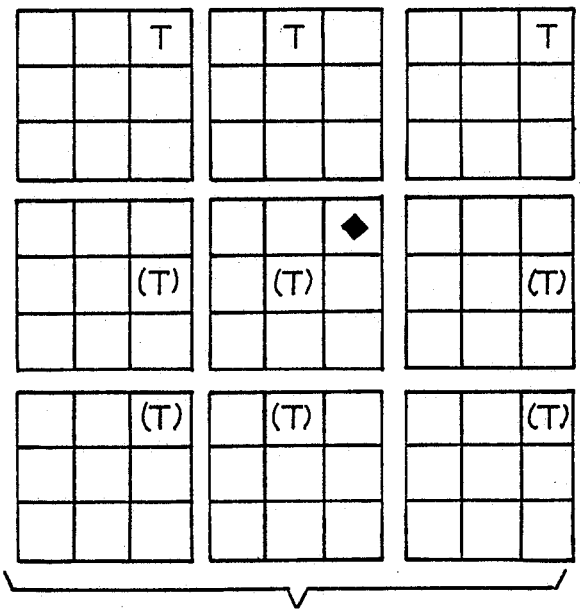

FIGS. 29 to 32 depict white and black kinged checkers indicated by various gemoetric shapes. Each white and black checker has a corresponding letter which is shown in every possible space to which that checker can move. For example, as shown in FIG. 29, checkers symbolized by a white circle and a black circle are shown in particular playing spaces on the board. As shown in FIG. 29, all of the possible spaces to which the white circle checker can move are indicated by an X, and all of the possible spaces to which the black circle checker can move are indicated by a Q. FIGS. 30 to 32 illustrate other possible moves which may be made by checkers locate on other positions of the board. Like FIG. 29, the checkers are depicted as white and black geometric shapes, and the possible spaces to which these checkers can move are indicated by letter coordinates as indicated, on each of the figures. The letters in parentheses indicate spaces to which only kinged checkers may move.

The checkers boards shown in FIGS. 21 to 32 may have indicia defining positional parameters as depicted for the various boards, or warps, shown in FIGS. 1 to 8. Each of the checkers boards shown may be considered as a primary playing board which may have equivalent boards, all of which are designated as warps, as shown in FIGS. 5 to 8. As with the game described in Example 1 and the warps described in Example 2, the exact number of warps employed in the checkers game may vary. The maximum number of warps permitted in a four-dimensional checkers game again would be 4! or 24.

In order to understand the relationship of the player spaces to each other on the various warps in a four-dimensional checkers game, navigational charts patterned after those shown in FIGS. 9 to 20, for example, may be employed as well. The use of more than one warp when playing a four-dimensional checkers game will enable one to obtain different perspectives on the development of the game itself as it is played as well as on the development of playing strategies.

The game boards, as well as the equivalent boards, of the present invention may be used on games other than those particularly described above. The game board and equivalent boards described may also be used to play games in more than four dimensions.

The primary board and equivalent boards, as well as the sequence of game boards, may also have a number of player spaces and arrangement of player spaces as well as fields other than the examples particularly described. The number of embodiments of this invention is therefore not intended to be limited to what is particularly described. All embodiments are limited only by the scope of the accompanying claims.

What is claimed is:

1. A game board comprising:

a playing area defined by four rows and four columns of four playing fields each, each playing field consisting of five columns and five rows of five player spaces each, and said four rows and four columns of four playing fields each also being defined as a first playing field and fifteen other playing fields, and wherein each of said player spaces has at least one indicia and each player space in each of the said fifteen other playing fields has one indicia common to at least one of the player spaces in said first playing field, and each player space in each of said four playing fields of each column of playing fields occupying the same relative spatial position in each of said playing fields in said column having one common indicia and one indicia which is different than any indicia in the other playing fields of such column.

2. A game board in accordance with claim 1 in which (a) each player space in the first playing field carries at least two different indicia, (b) each player space in each of the other playing fields carrying at least two different indicia at least one of which is the same as at least one of the two different indicia carried by the player spaces of the first playing field.

3. A game board in accordance with claim 2 in which (a) at least one of the indicia on each of the players spaces of the first playing field being the same as at least one of the indicia on each of the other player spaces on the first playing field defining a common indicia.

4. A game board in accordance with claim 3 which (a) at least one of the indicia in each of the player spaces of the fifteen other playing fields is the same as said common indicia.

5. A game board in accordance with claim 1 in which (a) each playing field in a row of playing fields has one common indicia, said common indicia is different from the common indicia of each playing field in the other said rows.

6. A game board in accordance with claim 5 in which (a) each playing field in a column of playing fields has at least twenty five common indicia and one different indicia from each of the other playing fields in said column.

7. A game board in accordance with claim 5 and (a) at least one player space in each playing field has an indicia which is different from all of the other indicia in said playing field and thereby defines a wild player space.

8. A game board in accordance with claim 6 and (a) at least one player space in each playing field has an indicia which said indicia is different from all of the other indicia in said playing field and thereby defines a wild player space.

9. A game board in accordance with claim 8 in which (a) each said wild player space has the same spacial position in each of the playing fields.

10. A game board in accordance with claim 9 in which (a) each wild player space is in the spatial center of each playing field.

11. A combination of a primary playing board and equivalent playing boards, each playing board consisting of an equal number of player spaces each having a positionally defined relationship to each of the other player spaces wherein:

(a) each player space of said primary playing board is defined by a permutation of at least four positional parameters, each player space in the primary board having one and only one equivalent space in each equivalent board;

(b) each equivalent player space on each equivalent board being defined by the same positional parameters as define each player space on the primary board, the permutation of positional parameters of each player space on each of the equivalent boards vary such that at least two positional parameters of each equivalent player space on each equivalent board have been interchanged with the positional parameters of its equivalent player space on each of the other equivalent player boards and the primary board; and (c) no two equivalent boards having the same permutation of positional parameters for each player space.

12. A game board comprising:

(a) a plurality of player spaces defining a playing area;

(b) a first playing field having no less than 3 of said player spaces each having a specific spatial relationship to each other arranged in at least one row of player spaces having no less than two player spaces each and at least one column of player spaces having no less than two player spaces each, at least one row of player spaces and one column of player spaces having a common player space;

(c) at least one column of spaced-apart playing fields one which includes said first playing field, each playing field in each column other than the first playing field having at least one player space; and (d) at least one row of spaced-apart playing fields one which includes said first playing field, each playing field in each row except the said first playing field having at least one player space each, at least one row of playing fields and one column of playing fields having a common playing field, and wherein the number of rows of player spaces in each playing field, the number of columns of player spaces in each playing field, the number of rows of spaced-apart playing fields, and the number of columns of spaced-apart playing fields are not all the same number.

13. A game board comprising:

(a) a plurality of player spaces defining a playing area;

(b) a first playing field having no less than three (3) of said player spaces each having a specific relationship to each other arranged in at least one row of player spaces having no less than two player spaces each and at least one column of player spaces having no less than two player spaces each, at least one row of player spaces and at least one column of player spaces having a common player space;

(c) at least one column of spaced-apart playing fields one which includes said first playing field, each playing field in each column other than the first playing field having at least one player space; and (d) at least one row of spaced-apart playing fields one which includes said first playing field, each playing field in each row except the said first playing field having at least one player space each, at least one row of playing fields and one column of playing fields having a common playing field, and wherein the number of player spaces in any one row of player spaces in any one field is not equal to the number of fields parallel to said any one row of player spaces.

14. The game board of claim 13 wherein the number of player spaces in any column of player spaces is not equal to the number of fields parallel to said any one column of player spaces.

15. A game board in accordance with claim 13 in which (a) each player space in the first playing fields carries at least two different indicia, (b) each player space in each of the other playing fields carrying at least two different indicia, at least one of which is the same as at least one of the two different indicia carried by the player spaces of the first playing field.

16. A game board in accordance with claim 15 in which (a) at least one of the indicia on each of the player spaces of the first playing field being the same as at least one of the indicia on each of the other player spaces on the first playing field thereby defining a common indicia.

17. A game board in accordance with claim 16 in which (a) at least one of the indicia in each of the player spaces of the other playing fields is the same as said common indicia.

18. A game board in accordance with claim 13 in which (a) each player space in the first playing field carries at least two different indicia, and (b) at least one player space in at least one of the other playing fields has only one indicia in which said one indicia is different than both of the two different indicia of each player spaces in the first playing field.

19. A game board in accordance with claim 13 in which at least one player space in at least one of the other playing fields in each row and column of playing fields has only one indicia in which said one indicia is different than the indicia of each of the player spaces of the first playing field.

20. A game board in accordance with claim 13 in which each of said other playing fields has the same number of player spaces as said first playing field.

21. A game board in accordance with claim 13, in which (a) each of said other playing fields has the same number of player spaces as said first playing field; and (b) each player space in each of the said other playing fields has one indicia common to at least one of the player spaces in the first playing field.

22. A game board in accordance with claim 21 in which (a) each player space in each playing field of each column of playing fields occupying the same relative spatial position in each of said playing fields in said column having one common indicia and one indicia which is different that any indicia in the other playing fields of such column.

23. A game board in accordance with claim 22 in which (a) at least one player space space in each playing field has an indicia which is different from all of the other indicia in said playing field and thereby defines a wild player space.

24. A game board in accordance with claim 23 in which (a) each said wild player space has the same spatial position in each of the playing fields.

25. A game board in accordance with claim 24 in which (a) each wild player space is in the spatial center of each playing field.

* * * * *